US006009626A

United States Patent [19]

Lei

[11] Patent Number: 6,009,626

[45] Date of Patent: Jan. 4, 2000

[54] TOOL FOR CRACKING ICE AND FROST

[76] Inventor: Leong Chi Lei, P.O. Box 82-144, Taipei, Taiwan

[21] Appl. No.: 09/165,101

[22] Filed: Oct. 2, 1998

[51] Int. Cl.[7] ..... B02C 18/00; F25C 5/16

[52] U.S. Cl. ..... 30/367; 30/164.5; 30/164.6; 30/164.7

[58] Field of Search ..... 30/164.5, 164.6, 30/164.7, 358, 366, 367

[56] References Cited

U.S. PATENT DOCUMENTS

| | | | |
|---|---|---|---|
| 797,824 | 8/1905 | Seitz | 30/367 |
| 1,424,221 | 8/1922 | Trumpeter | 30/164.5 |
| 1,701,771 | 2/1929 | Stefano | 30/164.7 |
| 2,384,707 | 9/1945 | Sweet | 30/367 |
| 4,268,927 | 5/1981 | Bridwell | 30/367 |
| 4,721,903 | 1/1988 | Harsch et al. | 30/367 |
| 5,662,686 | 9/1997 | Newsum | 30/367 |

FOREIGN PATENT DOCUMENTS

| | | | |
|---|---|---|---|
| 435627 | 9/1935 | United Kingdom | 30/367 |

*Primary Examiner*—Hwei-Siu Payer

*Attorney, Agent, or Firm*—A & J

[57] ABSTRACT

A tool for cracking ice and frost includes an outer tubular member, a T-shaped handle fixedly mounted on an upper end of the outer tubular member, a cylindrical sleeve having an axial through hole and an end formed with a flange, a conical head having a conical portion at one end thereof, a neck portion adjacent to the conical portion and a threaded portion at another end thereof, an inner tubular member being formed an internally threaded portion at one end thereof, an externally threaded portion at another end thereof, and an inner neck portion at an intermediate portion thereof, a striking pin provided with a sharp point at a lower end thereof and a flange at an upper end thereof, a guiding pin formed a cylindrical portion, an enlarged bottom at a lower end thereof, a rod portion having a smaller diameter than said cylindrical portion, and a conical portion between the cylindrical portion and the rod portion, a first helical spring provided with an eccentric lower end and arranged between the inner neck portion of the inner tubular member and the enlarged bottom of the guiding pin, a cylindrical hammer formed with an axial blind hole at a bottom thereof, a second helical spring being fitted within the inner tubular member, and a cap threadedly engaged with the upper end of the inner tubular member.

3 Claims, 3 Drawing Sheets

TOOL FOR CRACKING ICE AND FROST

BACKGROUND OF THE INVENTION

1. Field of the Invention

This invention is related to a tool and in particular to one for cracking ice and frost.

2. Description of the Prior Art

It has been found that an iron rod or spade is generally utilized to crack the ice and frost on the ground. However, it is difficult and requires a lot of effort for the operation thereby rendering them unfit for practical use.

Therefore, it is an object of the present invention to provide an improved tool for cracking ice and frost which can obviate and mitigate the above-mentioned drawbacks.

SUMMARY OF THE INVENTION

This invention is related to an improved tool for cracking ice and frost.

It is the primary object of the present invention to provide a tool which can effectively crack ice and frost.

It is another object of the present invention to provide a tool for cracking ice and frost which is easy to use.

It is still another object of the present invention to provide a tool for cracking ice and frost which is simple in construction.

It is still another object of the present invention to provide a tool for cracking ice and frost which is cheap and facile to manufacture.

It is a further object of the present invention to provide a tool for cracking ice and frost which is safe in use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
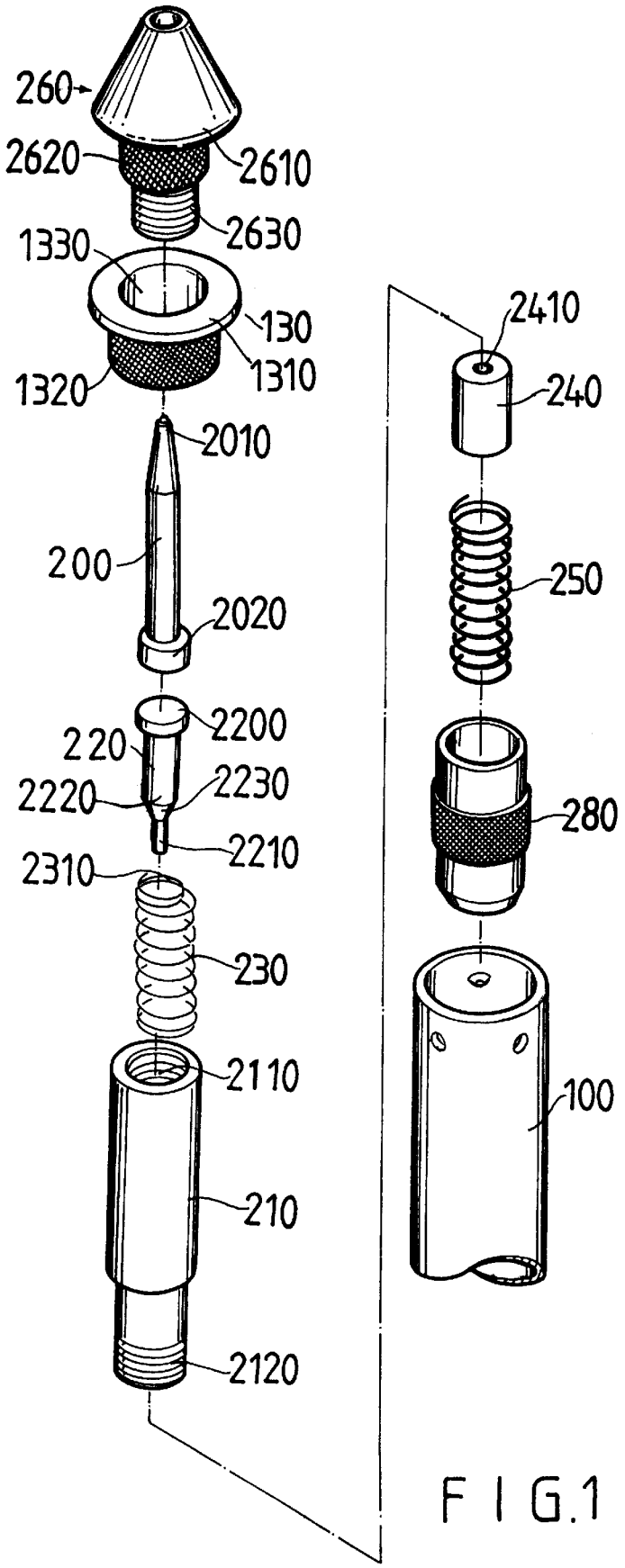
FIG. 1 is an exploded view of a tool for cracking ice and frost according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
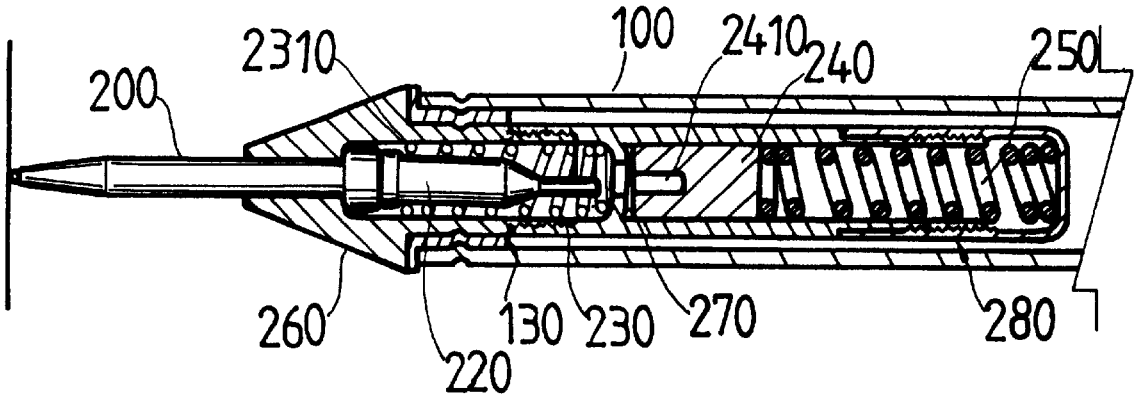
FIG. 2 is a sectional view of the tool.
Figure 5:
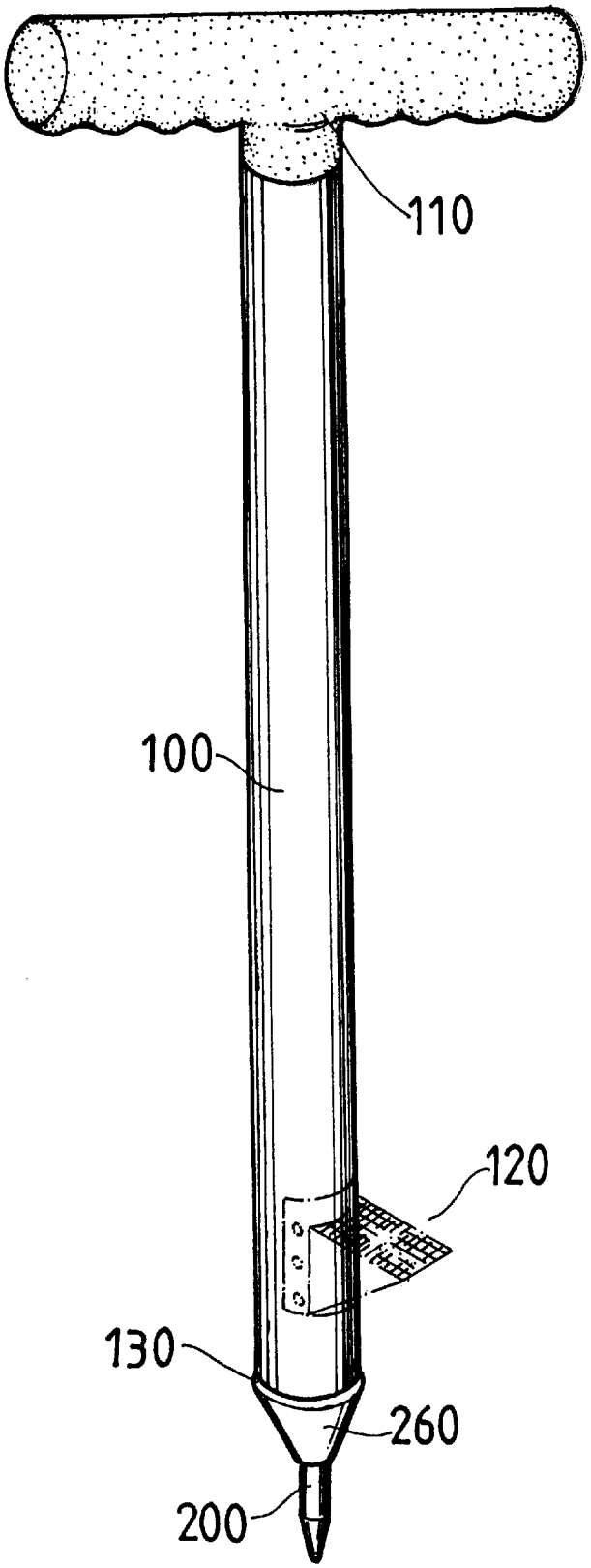
FIG. 5 is a perspective of the tool according to the present invention.

With reference to the drawings and in particular to FIGS. 1, 2 and 5 thereof, the tool for cracking ice and frost according to the present invention generally comprises an outer tubular member 100, a T-shaped handle 110, a conical head 260, a sleeve 130, a striking pin 200, a guiding pin 220, a first helical spring 230, an inner tubular member 210, a hammer 240, a second helical spring 250, and a cap 280.

The T-shaped handle 110 is fixedly mounted on the upper end of the outer tubular member 100. The sleeve 130 is a cylindrical member made of soft material and formed knurling 1320 on its cylindrical surface, a flange 1310 at its one end, and an axial through hole 1330. The sleeve 130 is snugly fitted into the lower end of the outer tubular member 100, with its flange 1310 bearing against the lower end of the outer tubular member 100.

The conical head 260 has a conical portion 2610 at one end, a neck portion 2620 adjacent to the conical portion 2610 and provided with knurling thereon, and a threaded portion 2630 at the other end. The conical head 260 is formed with an axial through hole with a smaller diameter at the lower portion and a larger diameter at the upper portion thereby forming a shoulder between the smaller and larger diameters. The conical head 260 is inserted into the sleeve 130, with the neck portion 2620 snugly fitted into the axial through hole 1330 of the sleeve 130 and bearing against the flange 1310 of the sleeve 130.

The inner tubular member 210 is formed an internally threaded portion 2110 at one end, an externally threaded portion 2120 at the other, and an inner neck portion 270 at the intermediate portion of the inner tubular member 210. The inner tubular member 210 is fitted into the outer tubular member 100, with its internally threaded portion 2110 engaged with the threaded portion 2630 of the conical head 260.

The striking pin 200 is provided with a sharp point 2010 at the lower end and a flange 2020 at the upper end. The striking pin 200 is inserted into the concial head 260 with its sharp point 2110 extending downwardly out of the conical head 260 and its flange 2020 supported by the shoulder 2660 of the conical head 260.

The guiding pin 220 is formed with a cylindrical portion 2220, an enlarged bottom 2200 at the lower end, a rod portion 2210 having a smaller diameter than the cylindrical portion 2220, and a conical portion 2230 between the cylindrical portion 2220 and the rod portion 2210. The guiding pin 220 is fitted into the conical head 260 with its enlarged bottom 2200 bearing against the flange 2020 of the striking pin 200. The rod portion 2210 is sized to fit into the axial blind hole 2410 of the hammer 240 and may have a length equal or longer than the depth of the axial blind hole 2410. The first helical spring 230 is provided with an eccentric lower end 2310 and put onto the guiding pin 220 with its upper and lower ends pushing against the inner neck portion 270 of the inner tubular member 210 and the enlarged bottom 2200 of the guiding pin 220 respectively. The eccentric lower end 2310 of the first helical spring 230 will make the guiding pin 220 locate at a slightly inclined position. Further, the first helical spring 230 urges the guiding pin 220 to push the striking pin 200 out of the concial head 260.

The hammer 240 is a cylindrical member formed with an axial blind hole 2410 at the bottom and arranged within the inner tubular member 210 and located on the inner neck portion 270 of the inner tubular member 210.

The second helical spring 250 is fitted within the inner tubular member 210 and the cap 280 is threadedly engaged with the upper end of the inner tubular member 210 thus causing the second helical spring 250 to push the hammer 240 against the inner neck portion 270 of the inner tubular member 210.

Figure 3:
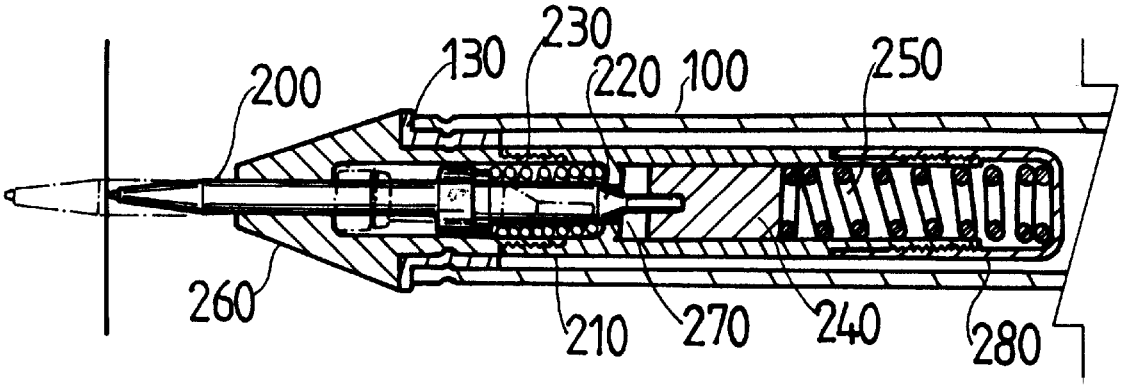
FIG. 3 illustrates the working principle of the tool.

When in use (see FIGS. 2 and 3), simply press the T-shaped handle 110 to make the striking pin 200 to go downwardly into the ice (not shown). Meanwhile, the striking pin 200 will go into the conical head 260 thereby moving the guiding pin 220 to go upwardly. As the enlarged bottom 2200 of the guiding pin 220 is pushed by the eccentric end 2310 of the first helical spring 230, the guiding pin 220 will be forced to locate at an inclined position so that the rod portion 2210 of the guiding pin 220 will not be aligned with the axial blind hole 2410 of the hammer 240. Hence, when the guiding pin 220 is moved upwardly, the rod portion 2210 of the guiding pin 220 will go through the inner neck portion 270 of the inner tubular member 210 to push the hammer 240 to go upwardly too. However, when the conical portion 2230 of the guiding pin 220 is engaged with the inner neck portion 270 of the inner tubular member 210, the rod portion 2210 of the guiding pin 220 will be guided to align with the axial blind hole 2410 of the hammer so that the second helical spring 250 will push the hammer 240 downwardly to hit onto the rod portion 2210 of the guiding pin 220 which will in turn strike the striking pin 200 to go further into the ice thereby cracking the ice easily.

In addition, the outer tubular member 100 is provided with a pedal 120 close to its lower end so that the user may put his foot thereon to push the striking pin 200 into the ice or frost (see FIG. 5).

Figure 4:
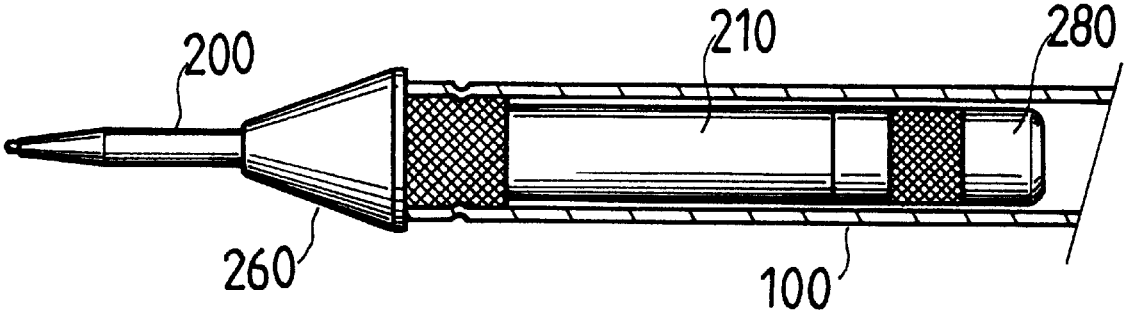
FIG. 4 illustrates another preferred embodiment of the present invention.

FIG. 4 illustrates a second preferred embodiment of the present invention. As shown, the sleeve 130 is omitted for reducing the size of the tool.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A tool for cracking ice and frost comprising:

an outer tubular member;

a T-shaped handle fixedly mounted on an upper end of said outer tubular member;

a cylindrical sleeve having an axial through hole and an end formed with a flange, said sleeve being snugly fitted into a lower end of said outer tubular member with said flange bearing against said lower end of said outer tubular member;

a conical head having a conical portion at one end thereof, a neck portion adjacent to said conical portion and a threaded portion at the other end thereof, said conical head having an axial through hole with a smaller diameter at a lower portion thereof and a larger diameter at an upper portion thereof, said conical head being inserted into said sleeve with said neck portion snugly fitted into said axial through hole of said sleeve and bearing against said flange of said sleeve;

an inner tubular member being formed an internally threaded portion at one end thereof, an externally threaded portion at the other end thereof, and an inner neck portion at an intermediate portion thereof, said inner tubular member being fitted into said outer tubular member with said internally threaded portion engaged with said threaded portion of said conical head;

a striking pin provided with a sharp point at a lower end thereof and a flange at an upper end thereof, said striking pin being inserted into said concial head with said sharp point extending downwardly out of said conical head and said flange of said striking pin supported by said conical head;

a guiding pin formed a cylindrical portion, an enlarged bottom at a lower end thereof, a rod portion having a smaller diameter than said cylindrical portion, and a conical portion between said cylindrical portion and said rod portion, said guiding pin being fitted into said conical head with said enlarged bottom bearing against said flange of said striking pin, said rod portion being sized to fit into an axial blind hole of a hammer;

a first helical spring provided with an eccentric lower end and arranged between said inner neck portion of said inner tubular member and said enlarged bottom of said guiding pin, said eccentric lower end of said first helical spring bearing against said enlarged bottom of said guiding pin to make said guiding pin locate at a slightly inclined position;

said hammer being cylindrical and having said axial blind hole formed at a bottom thereof and arranged within said inner tubular member and located on said inner neck portion of said inner tubular member;

a second helical spring being fitted within said inner tubular member; and a cap threadedly engaged with an upper end of said inner tubular member.

2. The tool for cracking ice and frost as claimed in claim 1, wherein said rod portion of said guiding pin has a length longer than a depth of said axial blind hole of said hammer.

3. The tool for cracking ice and frost as claimed in claim 1, further comprising a pedal fixedly mounted on a lower portion of said outer tubular member.

* * * * *